US007436383B2

(12) United States Patent
Chen et al.

(10) Patent No.: US 7,436,383 B2
(45) Date of Patent: Oct. 14, 2008

(54) DRIVING METHOD FOR CHOLESTERIC LIQUID CRYSTAL DISPLAY

(75) Inventors: Yen-Chen Chen, Tainan (TW); Chien-Pin Chen, Tainan (TW); Chia-Cheng Lai, Tainan (TW)

(73) Assignee: Himax Technologies, Inc., Tainan County (TW)

( * ) Notice: Subject to any disclaimer, the term of this patent is extended or adjusted under 35 U.S.C. 154(b) by 610 days.

(21) Appl. No.: 10/826,063

(22) Filed: Apr. 16, 2004

(65) Prior Publication Data

US 2004/0207587 A1 Oct. 21, 2004

(30) Foreign Application Priority Data

Apr. 18, 2003 (TW) ..... 92109064 A

(51) Int. Cl.
*G09G 3/36* (2006.01)

(52) U.S. Cl. ..... 345/94; 345/97

(58) Field of Classification Search ..... 345/87–104
See application file for complete search history.

(56) References Cited

U.S. PATENT DOCUMENTS 4,776,676 A * 10/1988 Inoue et al. ..... 349/85
6,414,666 B1 * 7/2002 Yamakawa et al. ..... 345/95
6,717,561 B1 * 4/2004 Pfeiffer et al. ..... 345/87
7,218,299 B2 5/2007 Yamakawa et al.
2003/0030612 A1 2/2003 Yip et al.

FOREIGN PATENT DOCUMENTS

CN 1440012 9/2003
WO 01/08130 A1 2/2001

* cited by examiner

*Primary Examiner*—Bipin Shalwala
*Assistant Examiner*—Steven E Holton
(74) *Attorney, Agent, or Firm*—Senniger Powers LLP

(57) ABSTRACT

The present invention relates to a driving method for cholesteric liquid crystal display. A plurality of pixels of the display are controlled by a plurality of row drivers and a plurality of column drivers. According to the method of the invention, firstly, a DC input voltage or a non-symmetric AC input voltage is applied to the row drivers and the column drivers so that the voltage of the pixel is larger than a withstand voltage of the drivers. Then, an initial column signal and an initial row signal are respectively supplied by the corresponding column driver and row driver so as to initialize the corresponding pixel. The polarity of the initial column signal is different from that of the initial row signal. Because the initial row signal minus the initial column signal equals the signal of the pixel, the amplitude of the signal applied to the pixel can be increased. Therefore, according to the invention, the initial time of the pixel can be decreased, and the transferring speed of the pixel can be improved.

9 Claims, 6 Drawing Sheets

DRIVING METHOD FOR CHOLESTERIC LIQUID CRYSTAL DISPLAY

BACKGROUND OF THE INVENTION

1. Field of the Invention

The present invention relates to a driving method for a cholesteric liquid crystal display, more particularly, to a single polarity driving method and a non-symmetric driving method for a cholesteric liquid crystal display.

2. Description of the Related Art

Referring to FIG. 1, a reflective cholesteric liquid crystal display 1 mainly comprises: a transparent glass 11, a plurality of liquid crystal units 12 and a light-absorbing glass 13. When a voltage is applied to the display 1, liquid crystal units 12 of the reflective cholesteric liquid crystal display 1 will arrange according to the applied voltage to show image (as shown in the middle diagram of FIG. 1). When there is no applied voltage, the reflective cholesteric liquid crystal display 1 has two stable states: a planar texture and a focal conic texture.

The planar texture is a bright state, that is, the liquid crystal units arrange with a rule on the turn (as shown in the left bottom diagram of FIG. 1), and the outside light can be through the transparent glass 11, the liquid crystal units 12 and the light-absorbing glass 13 with half quantities reflect. Therefore, the reflective cholesteric liquid crystal display 1 is usually utilized in electronic-Book etc., which does not need to often switch over the screen and can show the image using the outside light without the need of the applied voltage so as to save energy.

The focal conic texture is a dark state. In the dark state, the liquid crystal units 12 irregularly arrange (as shown in the right bottom diagram of FIG. 1), and the outside light disorderly enter and are completely absorbed by the light-absorbing glass 13. When there is no applied voltage, the stable state of the reflective cholesteric liquid crystal display 1 is determined by the previous applied voltage.

Referring to FIG. 2, the reflective cholesteric liquid crystal display comprises a plurality of pixels P11, P12, P21 and P22 to show image. The pixels are controlled by a plurality of column electrode C1, C2 and a plurality of row electrodes R1, R2. The pixels are disposed on crossing areas between the column electrodes and the row electrodes. For example, the pixel P11 is controlled by an applied signal combined from the column electrode C1 and the row electrode R1.

Referring to FIG. 3, in the prior art, the applied signal of the row electrode and the column electrode is usually a square wave. The applied signal of the pixel P11 equals the row signal of the row electrode R1 minus the column signal of the column electrode C1, and the applied signal of the pixel P21 equals the row signal of the row electrode R2 minus the cloumn signal of the column electrode C2. In the period t1, the applied signals of the pixels P11 and P21 are initial signals being square waves having positive amplitude and negative amplitude.

By utilizing the square wave having positive and negative amplitude, the conventional AC driving method can avoid the bad degraded affect to the liquid crystal driven by the direct voltage. However, the AC driving method has no help to the switching speed of the pixel. For example, the drivers applied to the column electrode and the row electrode can bear a withstand voltage of 40V, that is, the drivers applied to the column electrode and the column electrode can supply a maximum voltage of 40V. Then, the applied voltage of the pixel is ±40V. However, considering root mean square value, the root mean square value of the pixels is still 40V. Therefore, the root mean square value of the maximum applied voltage of the pixels is the same as the withstand voltage applied to the column electrode and the row electrode. Besides, the switching speed of the pixel is proportioned to the root mean square value of the applied voltage of the pixel. Accordingly, the conventional AC driving method cannot improve the switching speed of the pixel.

Therefore, it is necessary to provide a driving method so as to solve the above problem.

SUMMARY OF THE INVENTION

One objective of the present invention is to provide a single polarity driving method for a cholesteric liquid crystal display. The cholesteric liquid crystal display has a plurality of column electrodes, a plurality of row electrodes and a plurality of pixels disposed on crossing areas between the column electrodes and the row electrodes. At least one column driver is provided with driving signals to the column electrodes. The column driver has a first column input and a second column input. At least one row driver is provided with driving signals to the row electrodes. The row driver has a first row input and a second row input. The second row input of the row driver couples to the first column input of the column driver. The inputs of the row driver and the column driver are single polarity. The polarity of the input of the row driver is in reverse to that of the corresponding column driver.

The single polarity driving method comprises the steps of: (a) outputting an initial column signal to the corresponding column electrodes from the column driver, and outputting an initial row signal to the corresponding row electrodes from the row driver to initiate the corresponding pixel, wherein the initial column signal and the initial row signal are single polarity signals, and the polarity of the initial column signal is in reverse to that of the initial row signal so that an amplitude of an applied initial signal of the corresponding pixel is larger than a withstand voltage of the drivers, the applied initial signal of the corresponding pixel is single polarity; and (b) outputting a column address signal to the corresponding column electrodes from the column driver, and outputting a row address signal to the corresponding row electrodes from the row driver, wherein the column address signal and the row address signal are single polarity signals to control the corresponding pixel.

Because the polarity of the initial column signal is in reverse to that of the initial row signal, and the initial row signal and the initial column signal are square waves having the same amplitude, and the applied initial signal of the corresponding pixel equals the initial row signal minus the initial column signal, the applied initial signal has twice amplitude of the initial row signal or the initial column signal. Therefore, according to the driving method of the invention, the amplitude of the applied initial signal of the corresponding pixel can be increased to shorten the initial time of the pixel and to increase the switching speed of the pixel.

Besides, according to the driving method of the invention, the row driver or the column driver with low withstand voltage can be utilized to increase the withstand voltage of the pixel. The withstand voltage of the pixel is larger than the withstand voltage of the row driver or the column driver, and even the withstand voltage of the pixel is twice as large as the withstand voltage of the row driver or the column driver.

DETAILED DESCRIPTION OF THE INVENTION

Figure 1:
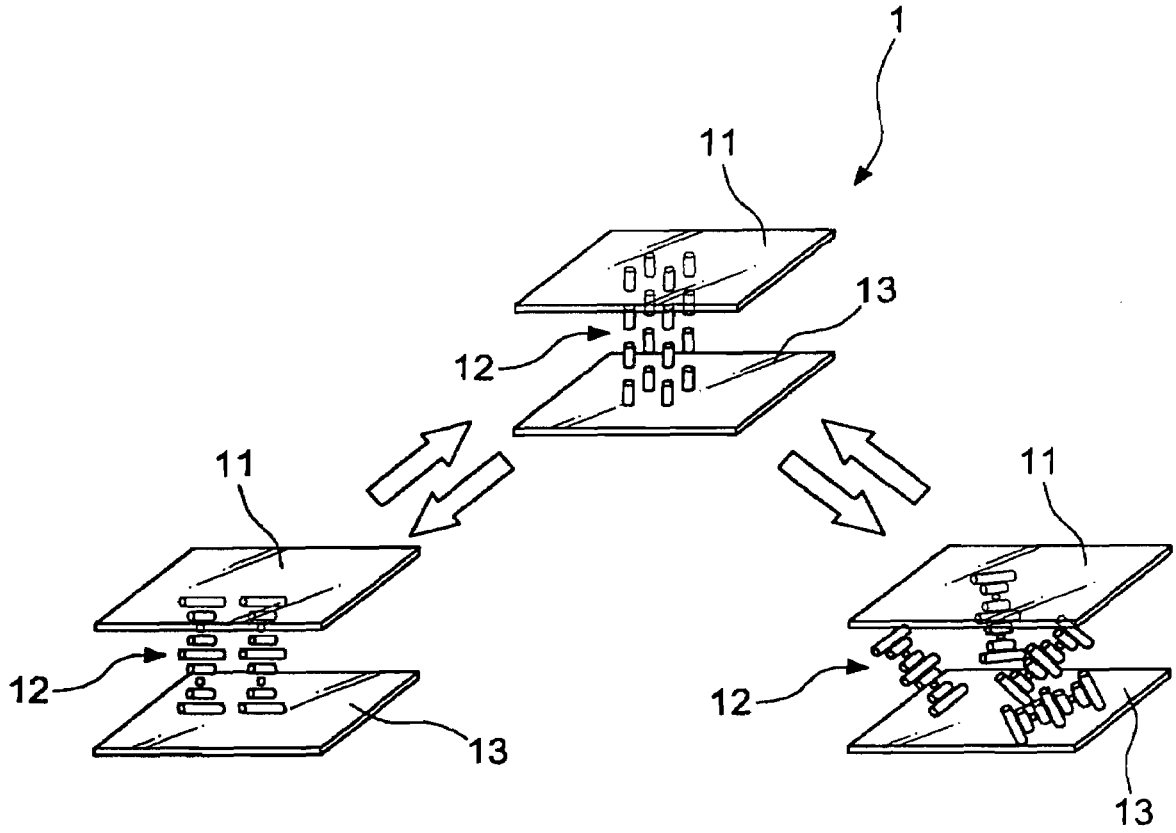
FIG. 1 PRIOR ART
FIG. 1 shows states of the conventional reflective cholesteric liquid crystal display.
Figure 2:
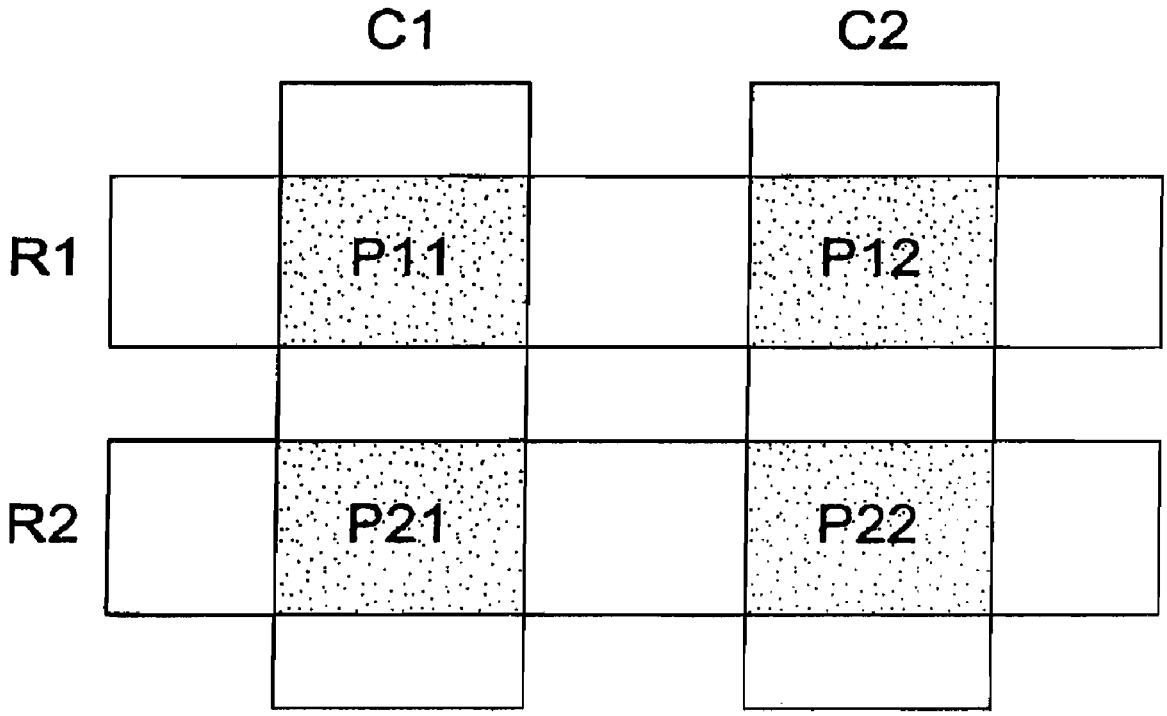
FIG. 2 PRIOR ART
FIG. 2 shows pixel arrangement and pixel driving of the conventional reflective cholesteric liquid crystal display.
Figure 3:
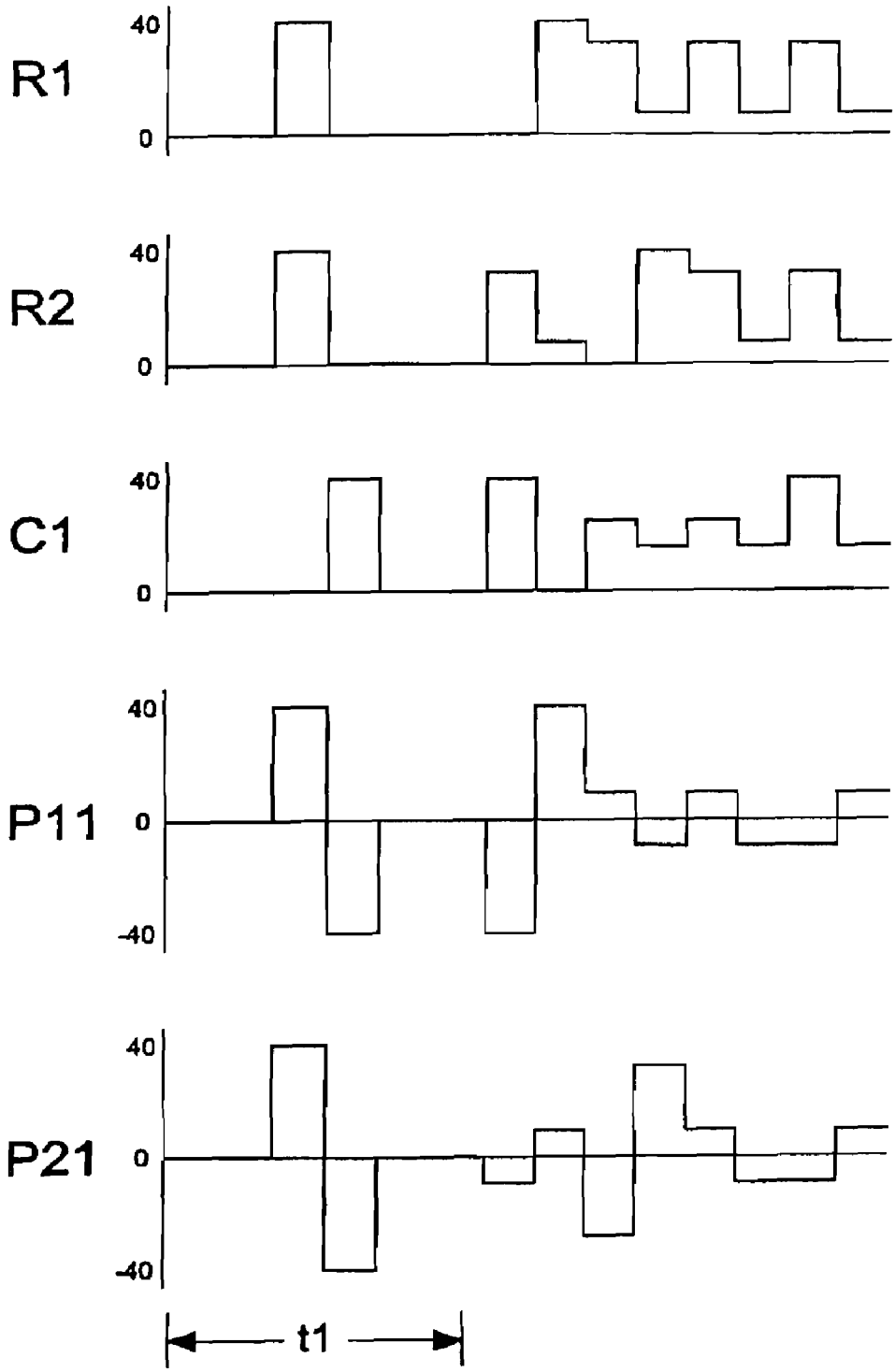
FIG. 3 PRIOR ART
FIG. 3 shows waveforms and timing according to the conventional driving method.
Figure 4A:
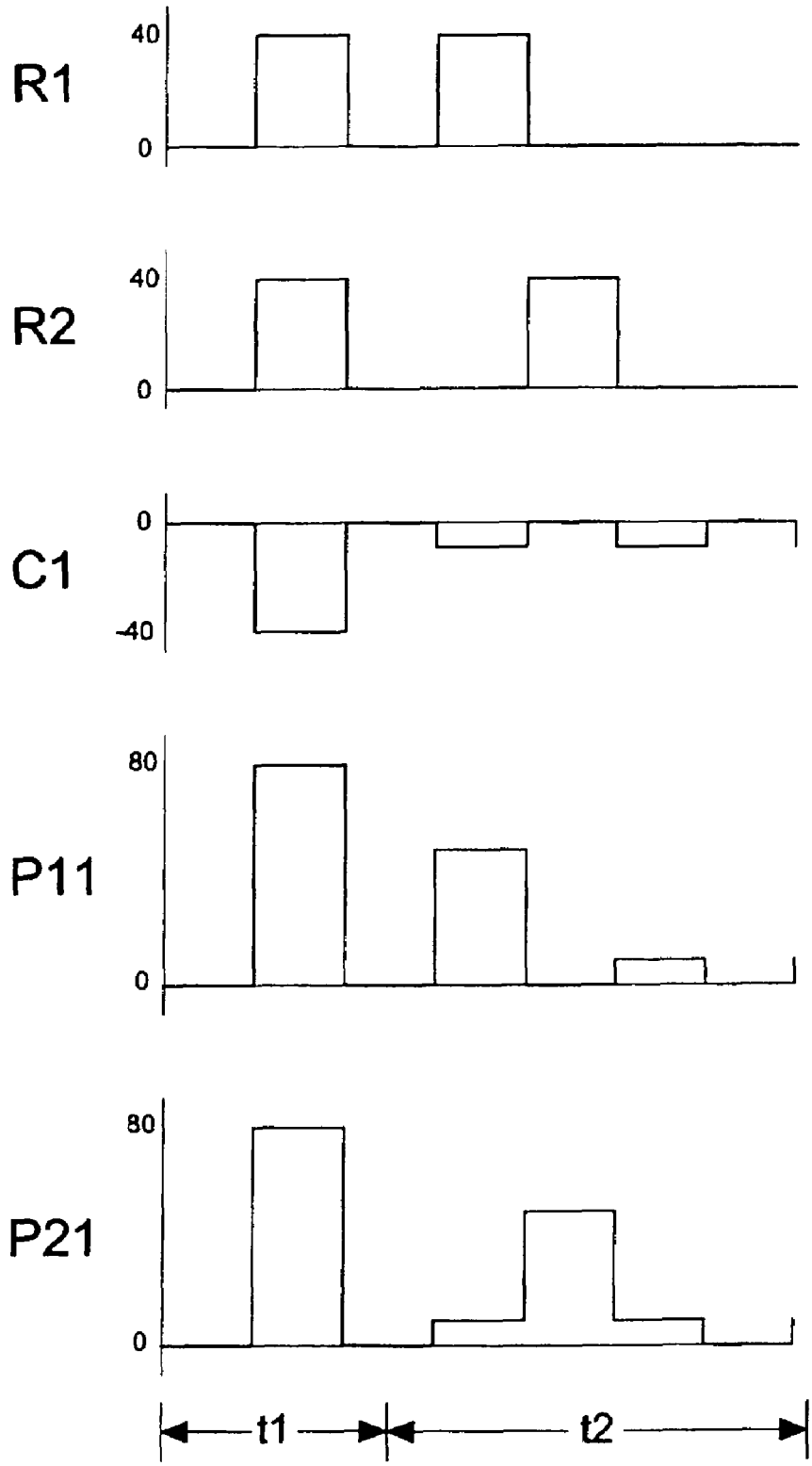
FIG. 4*a* shows waveforms and timing of the single polarity driving method according to the first embodiment of the invention.

Referring to FIG. 4*a* and FIG. 2, the cholesteric liquid crystal display comprises a plurality of pixels P11, P12, P21 and P22 to show image. The pixels are controlled by a plurality of column electrode C1, C2 and a plurality of row electrodes R1, R2. The pixels are disposed on crossing areas between the column electrodes and the row electrodes. For example, the pixel P11 is controlled by an applied signal combined from the column electrode C1 and the row electrode R1. The waveforms and timing of the first row electrodes R1, the second row electrodes R2, the first column electrode C1, the first pixel P11 and the second pixel P21 are shown to explain the single polarity driving method of the invention.

Figure 4B:
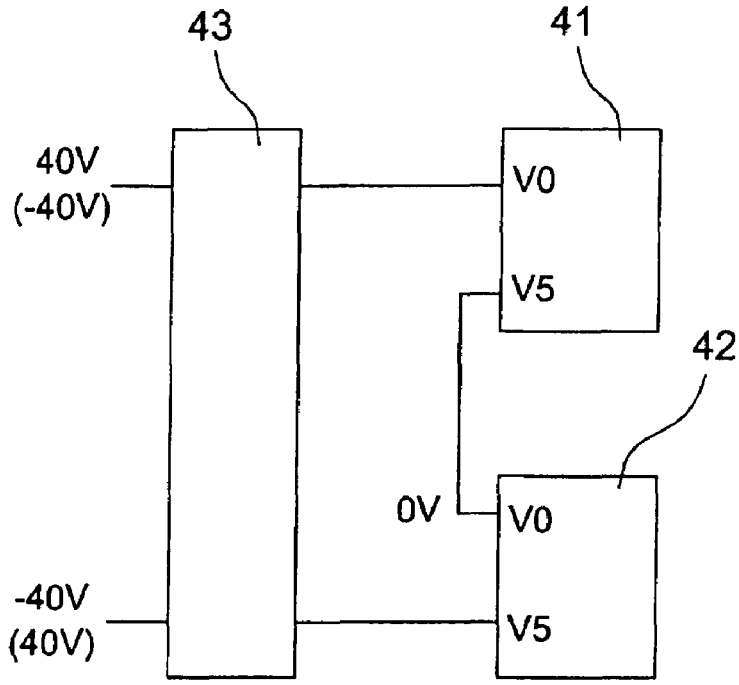
FIG. 4*b* shows the couple between the row driver, the column driver and power supply according to the single polarity driving method of the first embodiment of the invention.

Referring to FIG. 4*b*, a row driver 41 has a first row input 411 and a second row input 412, and a column driver 42 has a first column input 421 and a second column input 422. The second row input 412 of the row driver 41 couples to the first column input 421 of the column driver 42. The inputs of the row driver 41 and the column driver 42 are single polarity, and the amplitude of the input must be not larger than a withstand voltage of the row driver 41 or the column driver 42 (for example, 40V or −40V). The polarity of the input of the row driver 41 is in reverse to that of the corresponding column driver 42, that is, the input of the row driver 41 is 0V to 40 V, and the input of the column driver 42 is 0V to −40V.

Referring to FIG. 4*a* again, in the initial period t1, the row driver 41 outputs an initial row signal to the first row electrode R1, and the initial row signal is a positive square wave. The initial row signal of the second row electrode R2 also is a positive square wave. The amplitude of the positive square wave equals a withstand voltage of the row driver 41, for example 40V. The column driver 42 outputs an initial column signal to the first column electrode C1, and the initial column signal is a negative square wave. The amplitude of the negative square wave equals a withstand voltage of the column driver 42, for example, −40V.

The applied initial signal of the first pixel P11 equals the initial row signal of the first row electrode R1 minus the initial column signal of the first column electrode C1, and the applied initial signal of the second pixel P21 equals the initial row signal of the second row electrode R2 minus the initial column signal of the first column electrode C1. Therefore, the applied initial signals of the first pixel P11 and the second pixel P21 are positive square waves having positive twice the amplitude of the initial row signal or the initial column signal, for example, 80V (40-(−40V)). During the initial period, the applied initial signals of the first pixel P11 and the second pixel P21 are both twice as large as the withstand voltage of the row driver or the column driver. Considering the root mean square value, the root mean square value of the amplitude of the applied initial signal still equals twice the withstand voltage of the row driver or the column driver. Therefore, the amplitude of the applied initial signal of the pixels can be increased to shorten the initial time of the pixels and to increase the switching speed of the pixels.

According to the single polarity driving method of the invention, the row driver or the column driver with low withstand voltage can be utilized to increase the voltage of the applied initial signal of the pixel being twice as large as the withstand voltage of the row driver or the column driver.

In the addressing period t2, the row driver 41 outputs a row address signal to the first row electrode R1, and the column driver 42 outputs a column address signal to the first column electrode C1. A row address signal is output to the second row electrode R2. According to the above address signals, the first pixel P11 is driven as a reflective state (ON), and the second pixel P21 is driven as a non-reflective state (OFF). Therefore, the pixels are driven by the corresponding row electrode and column electrodes as the reflective state or the non-reflective state so as to show image.

The cholesteric liquid crystal display is usually utilized to the field without often switching the screen. According to the single polarity driving method of the invention, although the applied voltages of the pixels are DC voltage, the liquid crystal cells do not cause serious degraded effect. However, in order to resolve the degraded effect of the liquid crystal cells, a setting step is designed for setting the polarity of the initial column signal and the initial row signal before the initial period t1. Besides, a periodically switching step is designed for periodically switching the polarity of the initial row signal and the initial column signal. For example, at a suitable period, the initial row signal of the first row electrode R1 is changed to a negative square wave, and the initial column signal of the first column electrode C1 is changed to a positive square wave. Then, the applied initial signal of the first pixel P11 is a negative square wave. By periodically switching the polarity of the applied initial signal of the pixel, there is no degraded effect in the liquid crystal cells.

Referring to FIG. 4*b* again, according to the single polarity driving method of the invention, a switching circuit 43 is utilized to periodically switch the polarity of inputs of the column driver and the row driver. That is, the input voltage of the row driver 41 can be switched to 0 to −40V, and the input voltage of the column driver 42 can be switched to 0 to 40V. Similarly, there is no degraded effect in the liquid crystal cells. And, the row driver or the column driver with low withstand voltage (for example: ±40V) can be utilized to increase the voltage (for example: ±80V) of the applied initial signal of the pixel being twice as large as the withstand voltage of the row driver or the column driver.

Furthermore, in order to prevent the degraded effect in the liquid crystal cells, a discharging step or a discharging circuit is designed for coupling the applied initial signal of the pixel to a ground terminal before the initial period t1 or at a suitable period. Therefore, the liquid crystal cells of the pixels are not kept at a certain DC voltage so as to prevent the degraded effect in the liquid crystal cells.

Figure 5B:
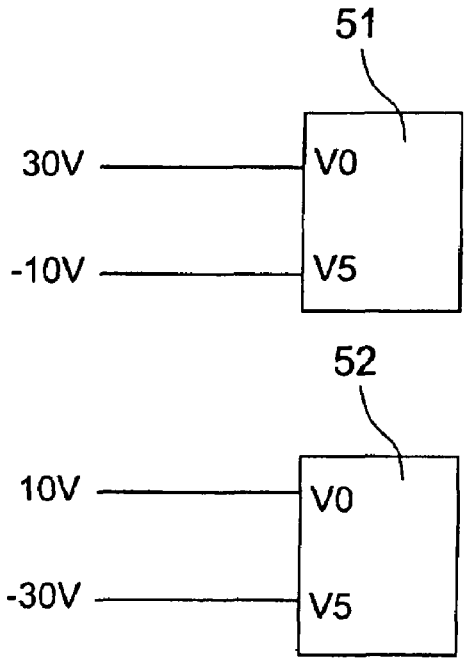
FIG. 5*b* shows the couple between the row driver, the column driver and power supply according to the non-symmetric AC driving method of the second embodiment of the invention.
Figure 5A:
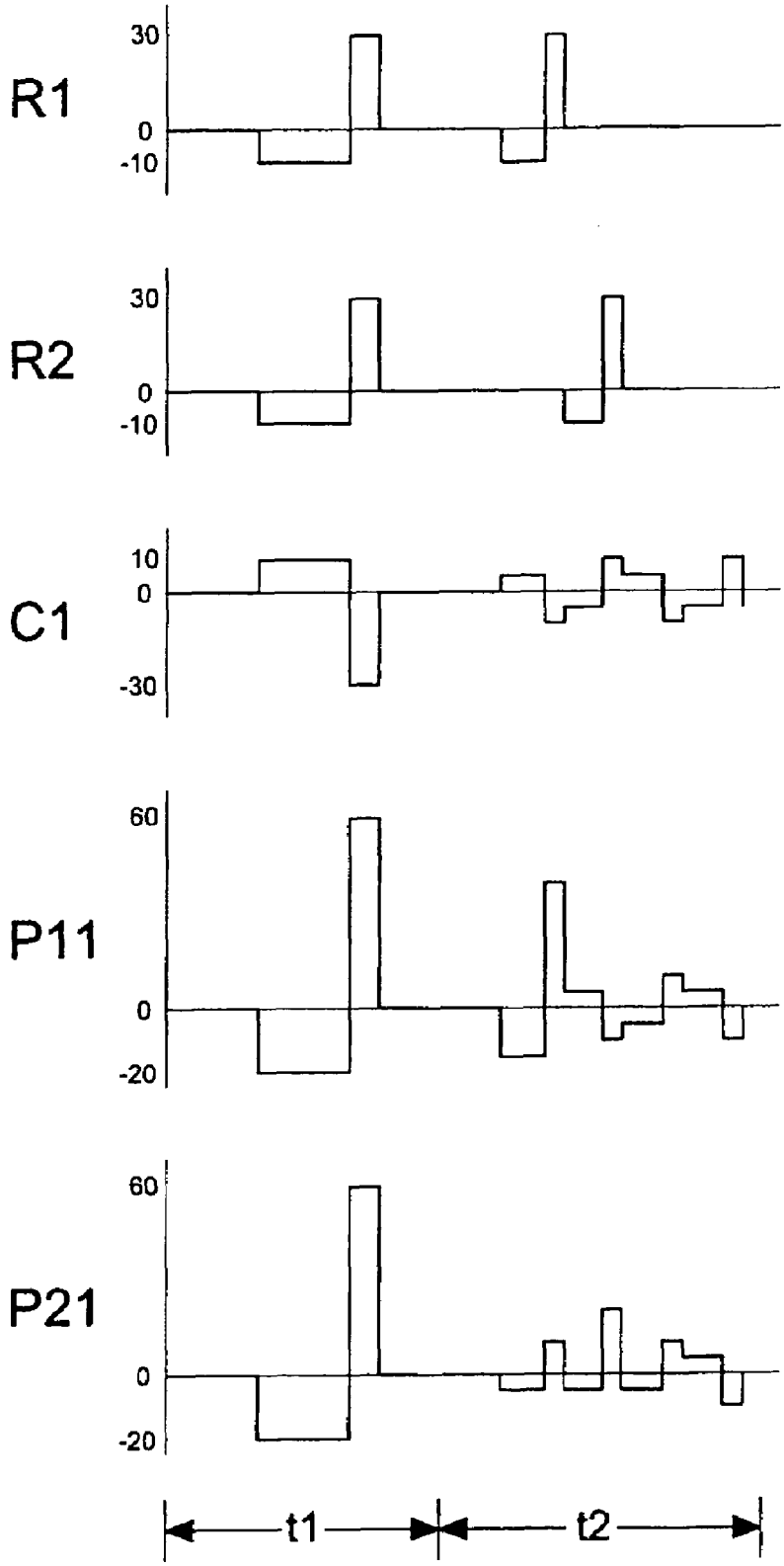
FIG. 5*a* shows waveforms and timing of the non-symmetric AC driving method according to the second embodiment of the invention.

Referring to FIG. 5*a*, in the second embodiment, the waveforms and timing of the first row electrodes R1, the second row electrodes R2, the first column electrode C1, the first pixel P11 and the second pixel P21 are shown to explain the non-symmetric AC driving method of the invention.

Referring to FIG. 5*b*, a row driver 51 has a first row input 511 and a second row input 512, and a column driver 52 has a first column input 521 and a second column input 522. Usually, a withstand voltage of the row driver 51 or the column driver 52 is 40V. The first row input 511 of the row driver 51 is input as 30V, and the second row input 512 of the row driver 51 is input as −10V. The first column input 521 of the column driver 52 is input as 10V, and the second column input 522 of the column driver 52 is input as −30V. The amplitude of the input of the row driver 51 or the column driver 52 must not be larger than the withstand voltage of he row driver 51 or the column driver 52.

Referring to FIG. 5*a* again, in the initial period t1, the row driver 51 outputs an initial row signal to the first row electrode R1, the initial row signal is a first non-symmetric AC signal. The first non-symmetric AC signal has a first waveform and a second waveform, the polarity of the first waveform is in reverse to that of the second waveform, and the amplitude of the first waveform is smaller than that of the second waveform. The first waveform is a negative square wave signal, and the second waveform is a positive square wave signal. In the second embodiment, the amplitude of the first waveform is −10V, and the amplitude of the second waveform is 30V.

The column driver 52 outputs an initial column signal to the first column electrode C1, the initial column signal is a second non-symmetric AC signal. The second non-symmetric AC signal has a third waveform and a fourth waveform, the polarity of the third waveform is in reverse to that of the fourth waveform, and the amplitude of the third waveform is smaller than that of the fourth waveform. The third waveform is a positive square wave signal, and the fourth waveform is a negative square wave signal. In the second embodiment, the amplitude of the third waveform is 10V, and the amplitude of the fourth waveform is −30V.

The applied initial signal of the first pixel P11 equals the initial row signal of the first row electrode R1 minus the initial column signal of the first column electrode C1. Therefore, at a first waveform period, the applied initial signal of the first pixel P11 is a negative square wave, and the amplitude of the applied initial signal of the first pixel P11 is −20V (−10−10). At a second waveform period, the applied initial signal of the first pixel P11 is a positive square wave, and the amplitude of the applied initial signal of the first pixel P11 is 60V (30−(−30)). The applied initial signal of the first pixel P11 is also a non-symmetric AC signal.

For a driving voltage lower than a critical value, the cholesteric liquid crystal cells can-not change the states. Utilizing the property of the cholesteric liquid crystal, a positive voltage higher than the critical value is applied to drive the pixels, and a negative voltage lower than the critical value is applied to the pixels so as to balance the liquid crystal cells and to prevent the degraded effect in the liquid crystal cells. In the second embodiment, the negative voltage (−20V) lower than the critical value is applied to the pixels so as to balance the liquid crystal cells, and the positive voltage (60V) higher than the critical value is applied to drive and initiate the pixels.

In the second embodiment, the positive voltage (60V) is applied to drive and initial the pixel P11. The positive voltage (60V) of the pixel P11 is larger than the withstand voltage (40V) of the row driver or the column driver. Therefore, the amplitude of the applied initial signal of the pixels can be increased to shorten the initial time of the pixels and to increase the switching speed of the pixels.

Similarly, a negative voltage higher than the critical value can be applied to drive the pixels, and a positive voltage lower than the critical value can be applied to the pixels so as to balance the liquid crystal cells and to prevent the degraded effect in the liquid crystal cells. In this situation, the first waveform of the initial row signal of the first row electrode R1 is a positive square wave signal, the second waveform is a negative square wave signal. The third waveform of the initial column signal of the first column electrode C1 is a negative square wave signal, and the fourth waveform is a positive square wave signal.

In the second embodiment, in the addressing period t2, a first row address signal, a second row address signal and a first column address signal are respectively provided to the first row electrode R1, the second row electrode R2 and the first column electrode C1. According to the above address signals, the first pixel P11 is driven as a reflective state (ON), and the second pixel P21 is driven as a non-reflective state (OFF). Therefore, the pixels are driven by the corresponding row electrode and column electrodes as the reflective state or the non-reflective state so as to show image.

Referring to FIG. 5*b* again, according to the non-symmetric AC driving method of the invention, a switching circuit (not shown) is utilized to periodically switch the polarity of inputs of the column driver and the row driver. That is, the input voltage of the row driver 51 can be switched to −30 to 10V, and the input voltage of the column driver 52 can be switched to −10 to 30V. Therefore, the row driver or the column driver with low withstand voltage (for example: 40V) can be utilized to increase the voltage (for example: 60V) of the applied initial signal of the pixel being larger than the withstand voltage of the row driver or the column driver.

The non-symmetric AC driving method of the invention may cause unbalance DC bias. In order to prevent the DC bias always applied to the liquid crystal cells, the non-symmetric AC driving method further comprises a discharging step for coupling the applied initial signal of the pixel to a ground terminal at a suitable period. Therefore, the liquid crystal cells of the pixels are not kept at a certain DC voltage so as to prevent the degraded effect in the liquid crystal cells by applying DC voltage for long time.

While an embodiment of the present invention has been illustrated and described, various modifications and improvements can be made by those skilled in the art. The embodiment of the present invention is therefore described in an illustrative, but not restrictive, sense. It is intended that the present invention may not be limited to the particular forms as illustrated, and that all modifications which maintain the spirit and scope of the present invention are within the scope as defined in the appended claims.

What is claimed is:

1. A single polarity driving method for a cholesteric liquid crystal display, the cholesteric liquid crystal display having a plurality of column electrodes, a plurality of row electrodes and a plurality of pixels disposed on crossing areas between the column electrodes and the row electrodes, at least one column driver providing with driving signals to the column electrodes, the column driver having a first column input and a second column input, at least one row driver providing with driving signals to the row electrodes, the row driver having a first row input and a second row input, the second row input of the row driver coupled to the first column input of the column driver, the inputs of the row driver and the column driver being single polarity, the polarity of the input of the row driver being reverse to that of the corresponding column driver, the single polarity driving method comprising the steps of:

(a) outputting an initial column signal to the corresponding column electrodes from the column driver, and outputting an initial row signal to the corresponding row electrodes from the row driver to initiate the corresponding pixel, wherein the initial column signal and the initial row signal are single polarity signals, and the polarity of the initial column signal is in reverse to that of the initial row signal so that an amplitude of an applied initial signal of the corresponding pixel is larger than a withstand voltage of the drivers, the applied initial signal of the corresponding pixel being single polarity; and (b) outputting a column address signal to the corresponding column electrodes from the column driver, and outputting a row address signal to the corresponding row electrodes from the row driver, wherein the column address signal and the row address signal are single polarity signals to control the corresponding pixel.

2. The method according to claim 1, wherein the initial row signal is a positive square wave having a positive amplitude and the initial column signal is a negative square wave having a negative amplitude.

3. The method according to claim 2, wherein the applied initial signal of the corresponding pixel equals the initial row signal minus the initial column signal, the applied initial signal is a positive square wave having twice positive amplitude.

4. The method according to claim 1, wherein the initial row signal is a negative square wave having a negative amplitude and the initial column signal is a positive square wave having a positive amplitude.

5. The method according to claim 4, wherein absolute value of the negative amplitude is the same as that of the positive amplitude.

6. The method according to claim 4, wherein the applied initial signal of the corresponding pixel equals the initial row signal minus the initial column signal, the applied initial signal is a negative square wave having twice negative amplitude.

7. The method according to claim 1, further comprising a setting step for setting the polarity of the initial column signal and the initial row signal before the step (a).

8. The method according to claim 1, further comprising a periodically switching step for periodically switching the polarity of inputs of the column driver and the row driver so that the polarity of input of the column driver is in reverse to that of the corresponding row driver.

9. The method according to claim 1, further comprising a discharging step for coupling the applied initial signal of the pixel to a ground terminal.

* * * * *